US006893241B2

(12) United States Patent
Yang

(10) Patent No.: US 6,893,241 B2
(45) Date of Patent: May 17, 2005

(54) COMPRESSOR

(75) Inventor: Kwang-Cik Yang, Changwon (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 10/332,390

(22) PCT Filed: Sep. 13, 2002

(86) PCT No.: PCT/KR02/01723

§ 371 (c)(1),
(2), (4) Date: Jan. 8, 2003

(87) PCT Pub. No.: WO03/040566

PCT Pub. Date: May 15, 2003

(65) Prior Publication Data

US 2004/0009084 A1 Jan. 15, 2004

(30) Foreign Application Priority Data

Nov. 6, 2001 (KR) ..... 2001-68915

(51) Int. Cl.[7] ..... F03C 2/00

(52) U.S. Cl. ..... 418/216; 418/60; 418/63; 418/124; 418/228

(58) Field of Search ..... 418/60, 63, 259, 418/124, 216, 228–232

(56) References Cited

U.S. PATENT DOCUMENTS 3,171,587 A * 3/1965 Schaller et al. ..... 418/124
3,767,335 A * 10/1973 Kramer et al. ..... 418/259
5,879,146 A * 3/1999 Van De Voort et al. .... 418/259
2003/0108438 A1 6/2003 Kim et al.

FOREIGN PATENT DOCUMENTS

| | | |
|---|---|---|
| DE | 42 18 385 A1 | 11/1993 |
| JP | 51-97006 | 8/1976 |
| KR | 10-0315954 B1 | 5/2001 |
| WO | WO 0181765 | 6/2003 |

* cited by examiner

*Primary Examiner*—Theresa Trieu
(74) *Attorney, Agent, or Firm*—Birch, Stewart, Kolasch & Birch, LLP

(57) ABSTRACT

A compressor comprising a hermetic casing, a cylinder assembly disposed in the casing, a Z-plate disposed in the cylinder assembly for dividing an inner space of the cylinder assembly into a plurality of compression spaces, and sucking, compressing and discharging a fluid while being rotated by a driving unit, and vanes being contacted with both sides of the Z-plate to make a reciprocal movement, wherein the cylinder assembly includes a vane slot for inserting the vane, said vane slot having an opened portion opened towards an outer circumference of the cylinder assembly, thereby facilitating a processing of the vane slot, enhancing productivity of the cylinder assembly and reducing a production cost.

8 Claims, 6 Drawing Sheets

COMPRESSOR

This application is the national phase under 35 U.S.C. § 371 of PCT International Application No. PCT/KR02/01723 which has an International filing date of Sep. 13, 2002, which designated the United States of America.

TECHNICAL FIELD

The present invention relates to a compressor using a vane, and more particularly, to a compressor to facilitate a processing, to enhance productivity and to reduce a production cost.

BACKGROUND ART

Generally, a compressor is a device for converting mechanical energy into compression energy of compressible fluid, and a refrigerating compressor is largely classified into a reciprocation compressor, a scroll compressor, a centrifugal compressor, and a rotary compressor by compression methods.

The present applicant has developed a Z-compressor with a novel concept, which can be classified as a rotary compressor, and filed an application for the invention to the Korean Intellectual Property Office (Application No. 10-1999-0042381, Application date: Oct. 1, 1999), which has been laid open May 7, 2001 with a publication number 2001-0035687.

The former application invention of the same applicant will now be described with reference to FIG. 1.

FIG. 1 is a longitudinal section view showing a Z-compressor in accordance with the conventional art, and FIG. 2 is a cut perspective view showing a compression part of a Z-compressor in accordance with the conventional art.

As shown in FIGS. 1 and 2, the Z-compressor is classified as a rotary compressor, and includes a hermetic casing 10; a motor part 20 provided in the casing 10 for generating rotation force; and a compression part 30 for sucking, compressing, and discharging fluid by the rotation force generated at the motor part 20.

The motor part 20 comprises of a stator 22 and a rotor 23 as usual.

The compression part 30 includes a cylinder assembly 31 fixed inside the casing 10 for forming a compression space V where fluid sucked from outside is compressed; a rotation shaft 25 for transmitting rotation force generated at the rotor 23 of the motor part 20; a Z-plate 35 engaged to the rotation shaft 25 and rotated for dividing the compression space V of the cylinder assembly 31 into a first space V1 and a second space V2; and first and second vanes 38 and 39 respectively contacted to upper and lower sides of the Z-plate 35 for dividing the first and second spaces V1 and V2 into a suction region and a compression region when the Z-plate rotates.

The cylinder assembly 31 includes a cylinder 50; and first and second bearing plates 40 and 60 fixed at both sides of the cylinder 50 for forming a compression space V with the cylinder 50.

The first and second bearing plates 40 and 60 formed as a disc type having a predetermined thickness and a size include journal portions 44 and 64 to a center of which the rotation shaft 25 is rotatively inserted, the rotation shaft 25 is prolonged and penetrated with a predetermined height and outer diameter; and first and second vane slots 42 and 62 formed at one side of the journal portions 44 and 64 for inserting the first and second vanes 38 and 39.

The first and second vane slots 42 and 62 are formed as a rectangular hole type to penetrate from an outer circumference of the circular first and second bearing plates 40 and 60 towards a center portion by corresponding to sizes of the first and second vanes 38 and 39. The Z-plate 35 is formed as a circular type in a front-projected view so that an outer circumference surface of the Z-plate 35 may slidably contact to an inner circumference surface of the cylinder 50, and formed as a cam surface of sine wave having the same thickness from the inner circumference surface to the outer circumference surface in a side-projected view. Accordingly, a surface of an upper dead point D1 is contacted to a lower surface of the first bearing plate 40, and a surface of a lower dead point D2 is contacted to an upper surface of the second bearing plate 60.

The first and second vanes 38 and 39 are formed as a rectangular plate type and formed to be contacted with the sine wave of the Z-plate 35 in the compression space V of the cylinder assembly 31.

The first and second vanes 38 and 39 include one side surfaces 38*a* and 39*a* formed concavely to be contacted to an outer circumference surface of a hub portion 25*a* formed at the rotation shaft 25; and the other side surfaces 38*b* and 39*b* formed convexly to be contacted to an inner circumference surface of the cylinder assembly 31.

When the Z-plate 35 is rotated, the first and second vanes 38 and 39 are guided to the first and second vane slots 42 and 62 in the compression space V of the cylinder assembly 31, and reciprocate along heights of a cam surface of the Z-plate 35, thereby dividing the compression space V into a suction region and a compression region.

Meanwhile, a reference numeral 14 indicates a suction flow path through which fluid is sucked in the casing 10 and the cylinder assembly 31, and a reference numeral 15 indicates a discharge pipe through which fluid is discharged outside the casing 10. Also, reference numerals 40 and 41 indicate discharge mufflers for reducing discharge noises.

A process for operating the Z-compressor in accordance with the conventional art will be explained.

First, when the rotation shaft 25 is rotated by a driving force of the motor part 20, the Z-plate 35 engaged to the rotation shaft 25 in the cylinder assembly 31 is simultaneously rotated, thereby sucking, compressing, and discharging fluid.

Namely, the first space V1 above the Z-plate 35 is divided into a suction region and a compression region by the upper dead point D1 of the Z-plate 35 and the first vane 38, and the second space V2 below the Z-plate 35 is divided into a suction region and a compression region by the lower dead point D2 of the Z-plate 35 and the second vane 39. Then, the Z-plate 35 is rotated, so that the upper dead point D1 and the lower dead point D2 of the Z-plate 35 move, thereby varying volumes of the suction regions and compression regions of the respective space.

At this time, the first and second vanes 38 and 39 make reciprocation to a reverse direction for a height of the cam surface of the Z-plate 35.

Accordingly, as soon as fluid is simultaneously sucked into each suction region of the first space V1 and the second space V2 through the suction flow path 14, compressed, and the upper dead point D1 or the lower dead point D2 of the Z-plate 35 reaches to a discharge starting point, fluid compressed through discharge flow path (not shown) of each space V1 and V2 is simultaneously discharged outside the cylinder assembly 31, and then exhausted outwardly through each discharge muffler 40 and 41, the casing 10, and the discharge pipe 15 step by step.

At this time, the first and second vane slots 42 and 62 support the first and second vanes 38 and 39 for moving up and down, and guide.

Accordingly, since the first and second vane slots 42 and 62 have to be formed to move the first and second vanes 38 and 39 up and down in a state that the compression spaces V1 and V2 formed in the cylinder assembly 31 are hermetic, a manufacturing processing of said vane slots has to be very delicately.

However, in the Z-compressor in accordance with the conventional art, the first and second vane slots 42 and 62 are formed as a rectangular hole type so as to correspond the first and second vanes 38 and 39 at the first and second bearing plates 40 and 60. According to this, a processing such as a wiring processing has to be used, thereby having a complicated fabricating processing for the cylinder assembly 31 and lowering productivity.

DISCLOSURE OF THE PRESENT INVENTION

Therefore, an object of the present invention is to provide a compressor, wherein a vane slot for being inserted a vane and guiding the reciprocation of the vane is opened towards an outer circumference of a cylinder assembly, thereby facilitating a processing, enhancing productivity, and reducing a production cost.

In order to achieve the above objects, there is provided a compressor comprising a hermetic casing, a cylinder assembly disposed in the casing and having a suction flow path and a discharge flow path, a Z-plate disposed in the cylinder assembly for dividing an inner space of the cylinder assembly into a plurality of compression spaces, and sucking, compressing and discharging a fluid while being rotated by a driving unit, and vanes being contacted with both sides of the Z-plate to make a reciprocal movement, and dividing each compression space into a suction region and a compression region, wherein the cylinder assembly includes a vane slot penetrated inward and outward the cylinder assembly for inserting the vane which is reciprocated, said vane slot having an opened portion opened towards an outer circumference of the cylinder assembly.

Also, to achieve the above objects, in the Z-compressor in accordance with the present invention, a fixing member is inserted and fixed to the opened part of the vane slot.

Also, to achieve the above objects, in the Z-compressor of the present invention, the fixing member includes: a supporting portion for being inserted in the opened portion of the vane slot and supporting the vane; and a fixing portion prolonged from the supporting portion and fixed to an outer side surface of the cylinder assembly.

MODE FOR CARRYING OUT THE PREFERRED EMBODIMENTS

The present invention will now be described with reference to accompanying drawings.

Figure 1:
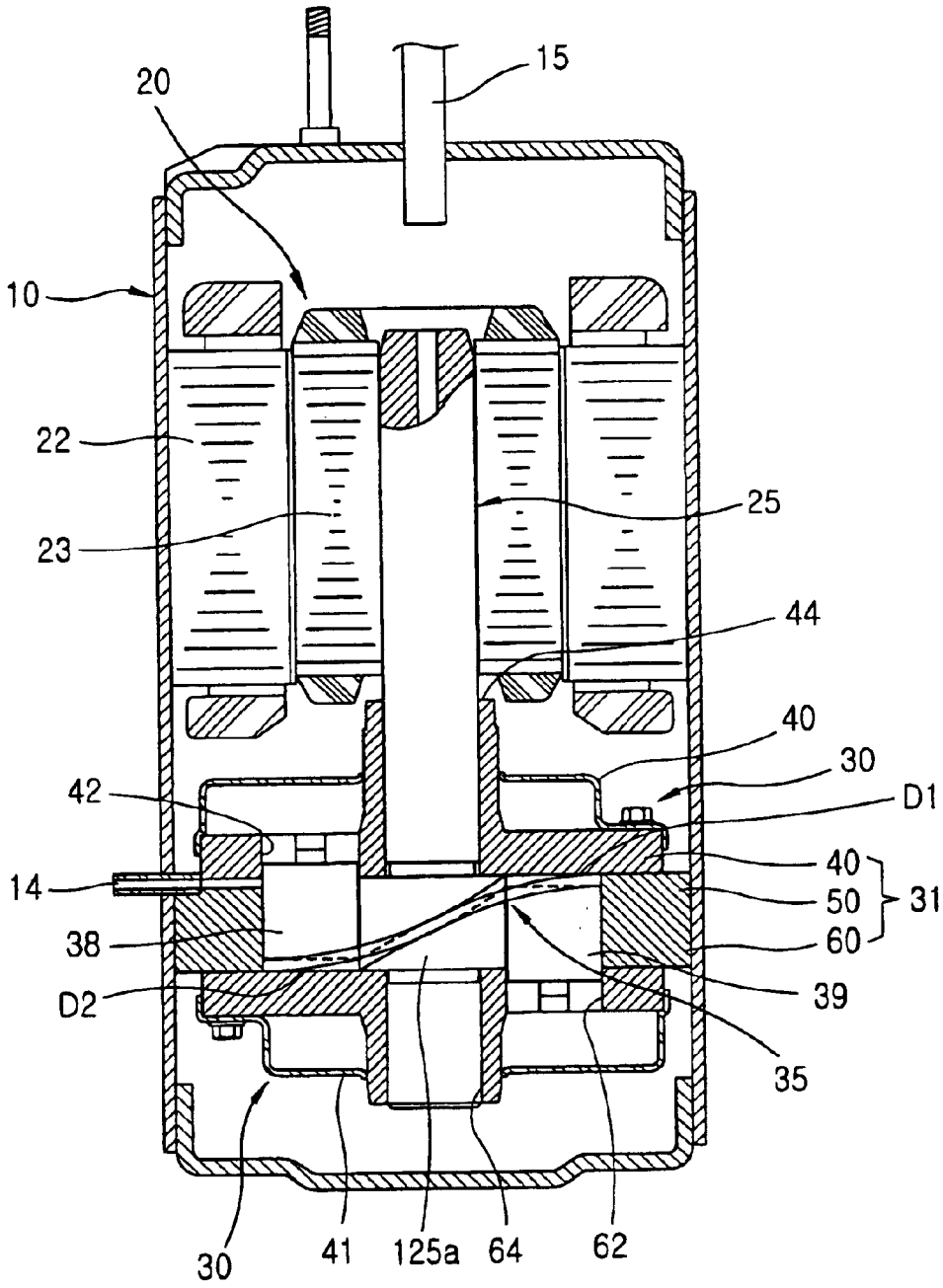
FIG. 1 CONVENTIONAL ART
FIG. 1 is a longitudinal section view showing a Z-compressor in accordance with the conventional art.
Figure 2:
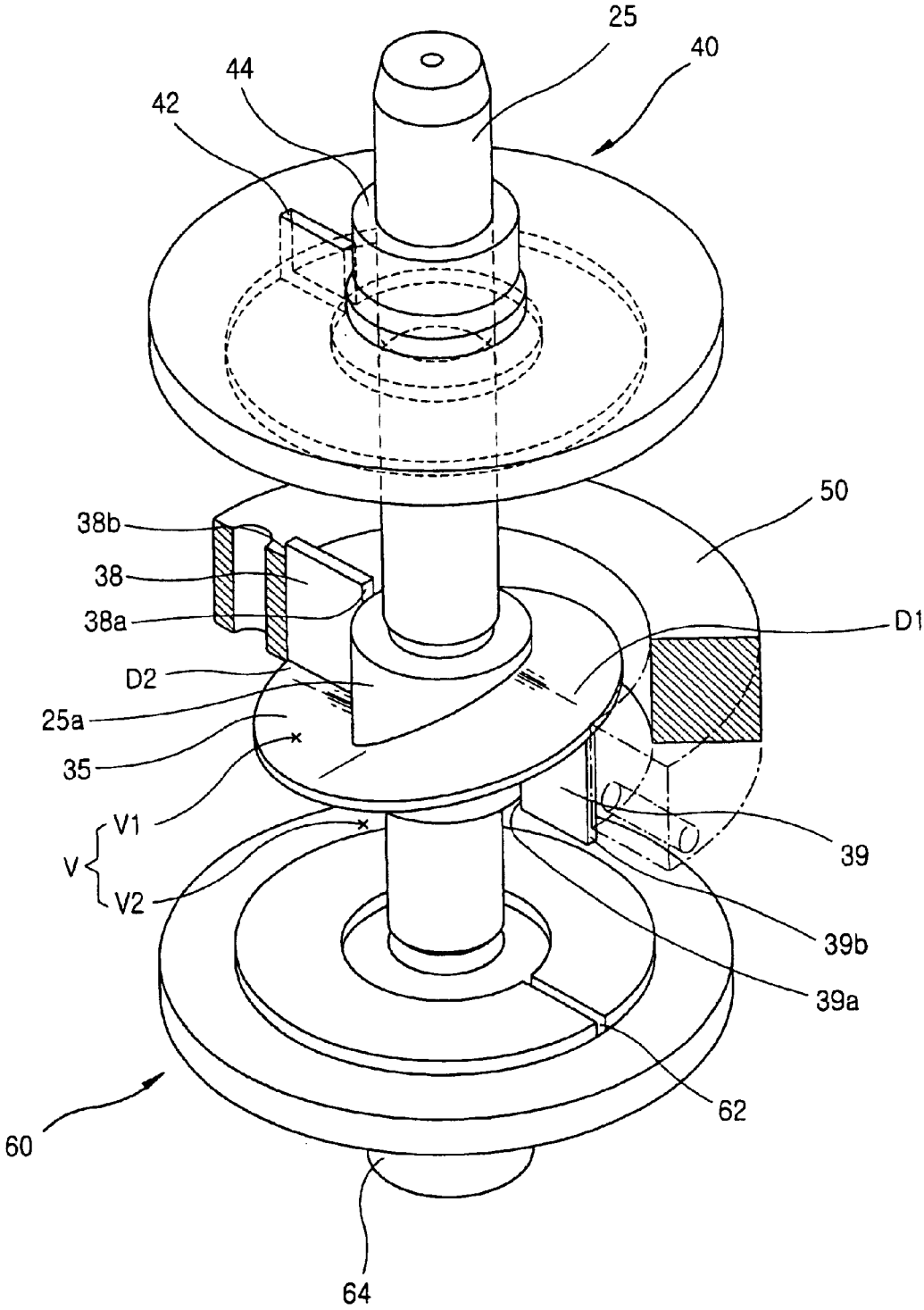
FIG. 2 CONVENTIONAL ART
FIG. 2 is a cut perspective view showing a compression device section of a Z-compressor in accordance with the conventional art.
Figure 3:
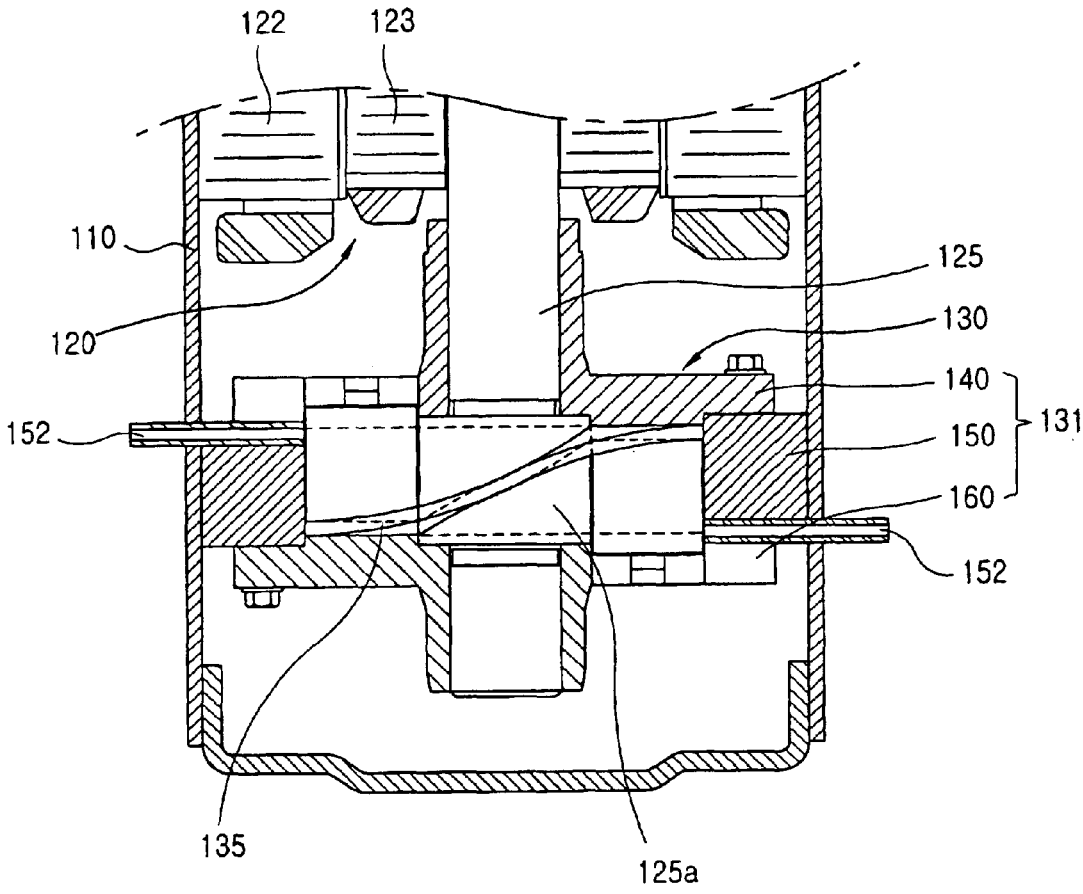
FIG. 3 is a longitudinal section view showing a main part of a Z-compressor according to one preferred embodiment of the present invention.
Figure 4:
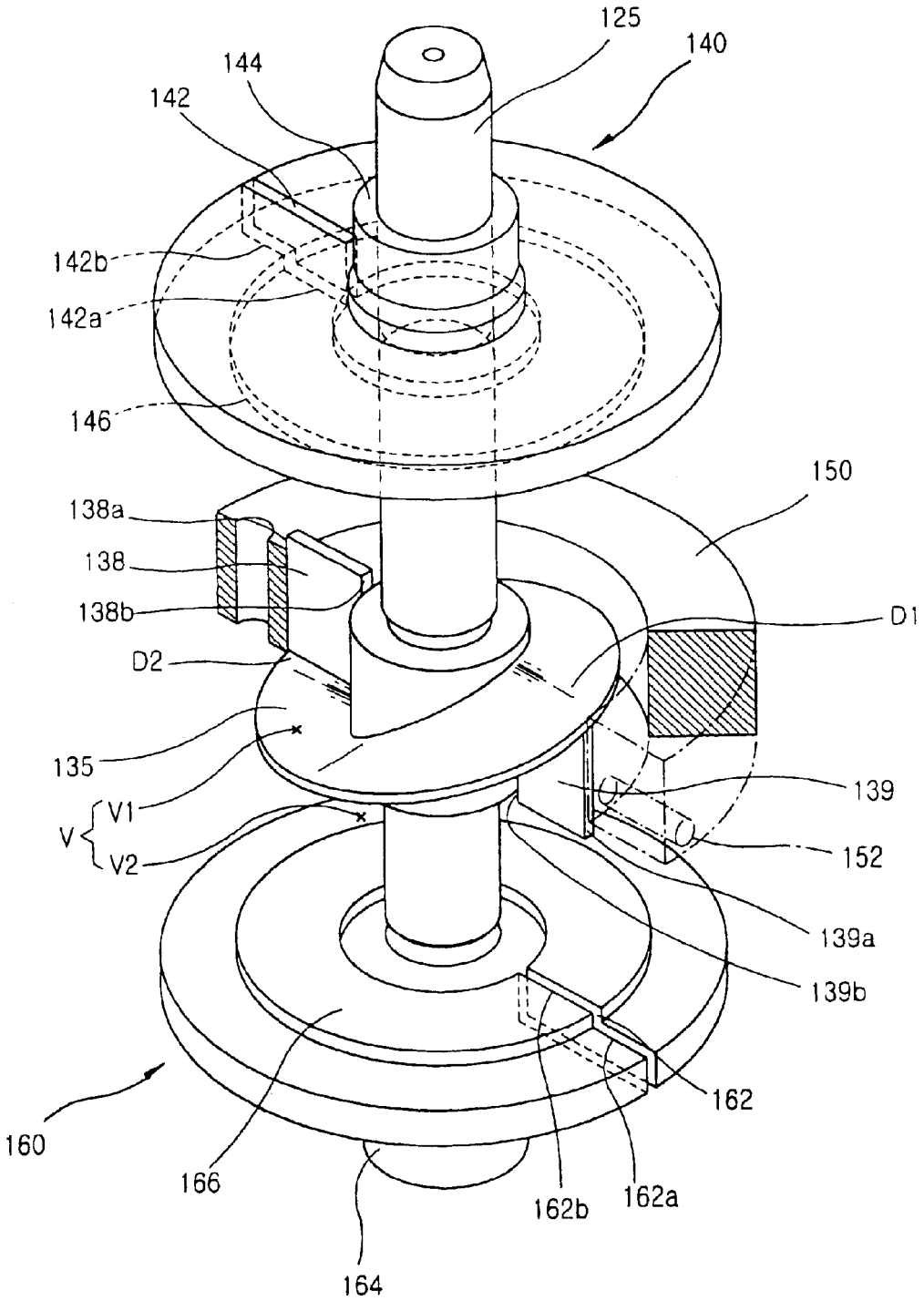
FIG. 4 is a cut perspective view showing a part of a compressor device section of a Z-compressor according to one preferred embodiment of the present invention.

FIG. 3 is a longitudinal section view showing a main part of a Z-compressor according to one preferred embodiment of the present invention, and FIG. 4 is a cut perspective view showing a part of a compressor device unit according to one preferred embodiment of the present invention.

As shown in FIGS. 3 and 4, the Z-compressor according to one preferred embodiment of the present invention comprises a hermetic casing 110; a motor part 120 provided in the casing 110 for generating rotation force; and a compression part 130 for sucking, compressing, and discharging fluid by the rotation force generated in the motor part 120.

The motor part 120 consists of a stator 122 and a rotor 123 as usual.

The compression part 130 includes a cylinder assembly 131 fixed at a lower side of the casing 110 for forming a compression space where fluid sucked from outside is compressed; a rotation shaft 125 for transmitting rotation force by being connected to the rotor 123 of the motor part 120; a Z-plate 135 engaged to the rotation shaft 125 in the cylinder assembly 131 for dividing the compression space into a first space V1 and a second space V2; and first and second vanes 138 and 139 respectively contacted to upper and lower side of the Z-plate 135 for dividing the first and second spaces V1 and V2 into a suction region and a compression region when the Z-plate rotates.

The cylinder assembly 131 includes a cylinder 150; and first and second bearing plates 140 and 160 fixed to both sides of the cylinder 150 for forming a compression space with the cylinder 150.

The first and second bearing plates 140 and 160 formed as a disc type having a predetermined thickness and a size include journal portions 144 and 164 prolonged and penetrated with a predetermined height and outer diameter to a center of the journal portions the rotation shaft 125 is rotatively inserted; and first and second vane slots 142 and 162 formed at one side of the journal portions 144 and 164 for inserting the first and second vanes 138 and 139.

Also, the first and second bearing plates 140 and 160 include a circle type engaging protrusion portion 166 protruded towards inner sides of the compression spaces V1 and V2 to a constant height with an outer diameter size corresponding to an inner diameter of the cylinder 150, wherein a protruded side of the engaging protrusion portion 166 slides with a cam surface corresponding to an upper dead point D1 and a lower dead point D2 of the Z-plate at the time of operating the compressor.

The first and second vane slots 142 and 162 are formed to correspond shapes of the first and second vanes 138 and 139, and as shown in FIG. 4, one side of which is opened towards an outer circumference of the cylinder assembly 131.

In more detail, the first and second vane slots 142 and 162 include vane insertion portions 142*a* and 162*a* for inserting the first and second vanes 138 and 139; and opening portions 142*b* and 162*b* formed towards an outer circumference of the bearing plate from the vane insertion portions 142*a* and 162*a*.

Accordingly, one sides 138*a* and 139*a* of the first and second vanes 138 and 139 inserted into the first and second vane slots 142 and 162 are contacted to an outer circumference surface of a hub portion 125*a* formed at the rotation shaft 125, and the other sides 138*b* and 139*b* are contacted to an inner circumference surface of the cylinder 150 and supported by the first and second vane slots 142 and 162, thereby making reciprocation.

Operations and effects of a Z-compressor according to one preferred embodiment of the present invention will be explained.

First, when a power is applied to the motor part 120, the rotation shaft 125 is rotated by a rotation of the rotor 123, and the Z-plate 135 engaged to the hub portion 125*a* of the rotation shaft 125 is rotated. Accordingly, compression spaces V1 and V2 in the cylinder 150 are respectively divided into a suction region and a compression region by the first and second vanes 138 and 139, so that fluid is sucked through a suction flow path 152, compressed, and discharged through each discharge flow path (not shown).

At this time, when the Z-plate 135 is rotated, the first and second vanes 138 and 139 reciprocate in the compression spaces according to heights of the cam surface of the Z-plate 135 and divide the compression spaces into a suction region and a compression region.

Herein, the first and second vane slots 142 and 162 formed in the first and second bearing plates 140 and 160 guide reciprocation of the first and second vanes 138 and 139.

Meanwhile, since the engaging protrusion portions 146 and 166 are formed at the first and second bearing plates 140 and 160, even if the first and second vanes 138 and 139 are located to each upper dead point, compression spaces in the cylinder assembly 131 maintain a hermetic state.

In the bearing plate of a Z-compressor according to one preferred embodiment of the present invention, the vane slot is opened towards an outer circumference of the bearing plate, thereby facilitating a processing of the vane slot and improving productivity in a manufacturing process of the bearing plate. Especially, since a broaching process having a high uniformity and profitable to a mass production can be applied with one processing, productivity and quality of the bearing plate can be enhanced.

Figure 5:
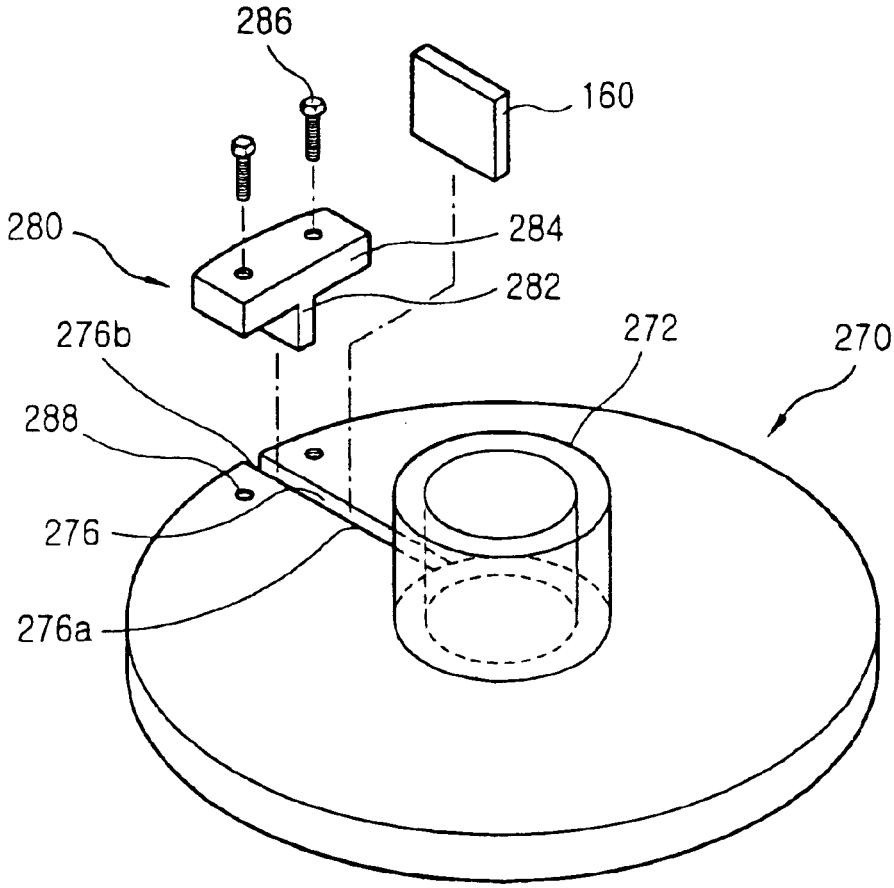
FIG. 5 is a disassembled view showing a vane slot structure of a Z-compressor and a vane according to another preferred embodiment of the present invention.

Referring to FIG. 5 the compressor according to another preferred embodiment of the present invention will be explained. Hereinafter, the same construction parts with the one preferred embodiment of the present invention will be the same, and explanation will be omitted.

Figure 6:
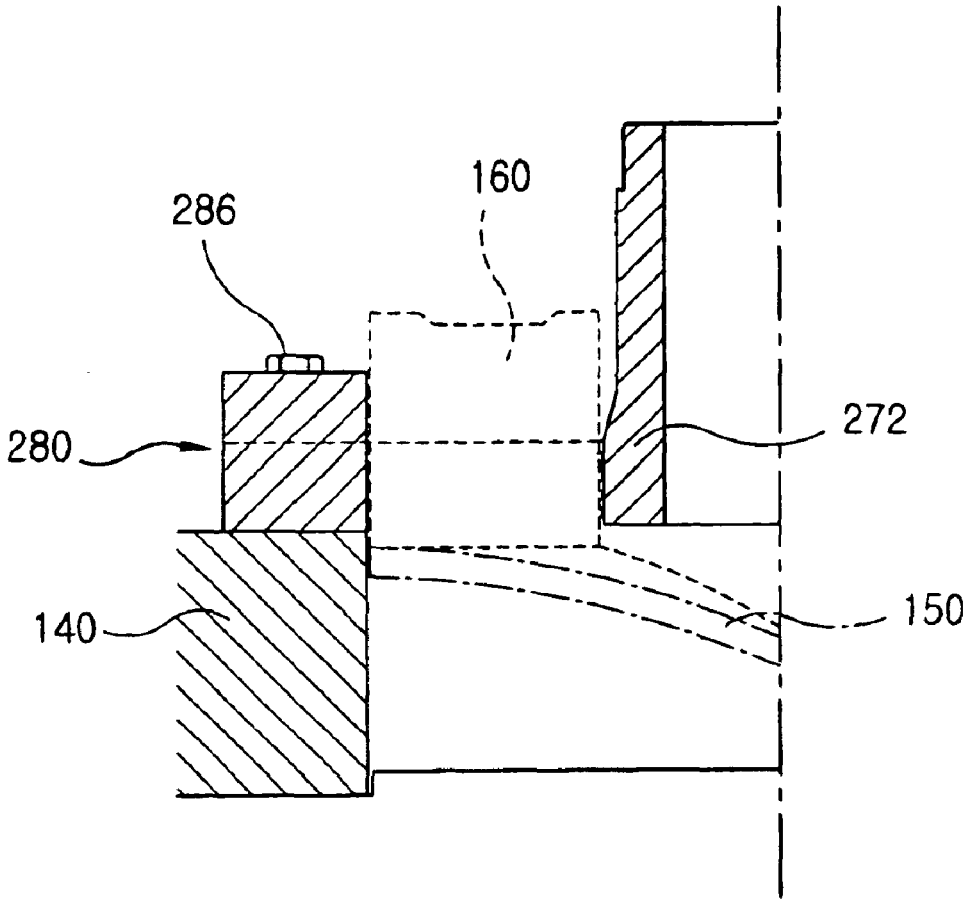
FIG. 6 is a partial section view showing a vane slot structure of a Z-compressor and a vane according to another preferred embodiment of the present invention.

FIG. 5 is a disassembled view showing a vane slot structure of a Z-compressor and a vane according to another preferred embodiment of the present invention, and FIG. 6 is a partial section view showing a vane slot structure of a Z-compressor and a vane according to another preferred embodiment of the present invention.

A vane slot 276 of a Z-compressor according to another preferred embodiment of the present invention is formed at one side of a journal portion 272 of a bearing plate 270 and includes a vane insertion portion 276*a* for inserting a vane 160 and an opening portion 276*b* opened towards an outer circumference of the bearing plate 270 from the vane insertion portion 276*a*.

Also, the opening portion 276*b* includes a fixing member 280 inserted to prevent the vane 160 from swinging towards a lateral direction when the vane 160 makes reciprocation up and down in the vane slot 276, and to prevent the bearing plate 270 from being distorted towards a circumference direction as the vane slot 276 is opened towards one side.

Herein, the fixing member 280 includes a supporting portion 282 for being inserted in the vane slot 276 and maintaining the vane; and a fixing portion 284 prolonged to both sides from one end of the supporting portion 282 and engaged to the bearing plate 270.

Herein, a bolt hole 288 is formed at a predetermined part of an interconnected portion between the fixing portion 284 of the fixing member 280 and the bearing plate 270, and engaged to an engaging bolt 286.

The vane slot 276 of a Z-compressor according to another preferred embodiment of the present invention has one side opened towards an outer circumference of the bearing plate 270. Also, at the opened portion, the fixing member 280 is inserted and fixed so as to prevent the vane 160 from swinging right and left when the vane 160 makes reciprocation up and down in the vane slot 276 and to prevent a distortion of the bearing plate 270 which is caused by the structure that one side of the vane slot 276 is opened, thereby facilitating a processing of the vane slot 276 and preventing a distortion of the bearing plate 270.

In the meantime, even though a structure that one side of the vane slot is opened towards an outer circumference of the bearing plate is illustrated, another structure that one side of the vane slot is opened towards an inner circumference of the bearing plate, that is, towards a direction that the rotation shaft is located, can be formed according to installation conditions of the bearing plate.

In the Z-compressor according to the present invention, the vane slot in which the vane is inserted is opened towards an outer circumference of the cylinder assembly, thereby facilitating a processing of the vane slot, enhancing productivity of the compressor, and reducing a production cost.

As so far described, according to the Z-compressor of the present invention, a vane slot in which a vane is inserted is opened towards an outer circumference of a cylinder assembly, thereby facilitating a processing, enhancing productivity of a compressor, and reducing a production cost.

What is claimed is:

1. A compressor comprising a hermetic casing, a cylinder assembly disposed in the casing and having a suction flow path and a discharge flow path, a Z-plate disposed in the cylinder assembly for dividing an inner space of the cylinder assembly into, a plurality of compression spaces, and sucking, compressing and discharging a fluid while being rotated by a driving unit, and vanes being contacted with both sides of the Z-plate to make a reciprocal movement, and dividing each compression space into a suction region and a compression region, wherein the cylinder assembly includes:

a vane slot formed through the cylinder assembly for inserting the vane and having an opened portion opened towards an outer circumference of the cylinder assembly, wherein a fixing member is inserted and fixed to the opened portion.

2. The compressor of claim 1, wherein the fixing member includes:

a supporting portion inserted in the opened portion of the vane slot for supporting the vane; and a fixing portion prolonged from the supporting portion and fixed to an outer side surface or the cylinder assembly.

3. The compressor of claim 1, wherein the cylinder assembly includes:

a cylinder; and first and second bearing plates fixed at both sides of the cylinder for forming the compression spaces with the cylinder, wherein the vane slot is formed at the bearing plate.

4. The compressor of claim 3, wherein the bearing plate includes an engaging protrusion portion having an outer diameter size corresponding to an inner diameter of the cylinder and protruded towards an inner side of the compression spaces.

5. A bearing plate of a compressor fixed at both sides of a cylinder for forming compression spaces with the cylinder, wherein a vane slot is formed through the cylinder to insert the vane and guide reciprocal movement of the vane, the vane slot has an opened portion opened towards an outer circumference of the cylinder, and wherein a fixing member for supporting the vane is inserted and fixed at the opened portion.

6. The bearing plate of a compressor of claim 5, wherein an engaging protrusion portion is formed toward an inner side of the compression space with an outer diameter size corresponding to an inner diameter of the cylinder.

7. The bearing plate of a compressor of claim 5, wherein the fixing member includes:

a supporting portion inserted in the opened portion of the vane slot for supporting the vane; and a fixing portion prolonged from the supporting portion and fixed at an outer surface of the bearing plate.

8. A compressor comprising a hermetic casing, a cylinder assembly disposed in the casing and having a suction flow path and a discharge flow path, a Z-plate disposed in the cylinder assembly for dividing an inner space of the cylinder assembly into a plurality of compression spaces, and sucking, compressing and discharging a fluid while being rotated by a driving unit, and vanes being contacted with both sides of the Z-plate to make a reciprocal movement, and dividing each compression space into a suction region and a compression region, wherein the cylinder assembly includes:

a vane slot formed through the cylinder assembly for inserting the vane, the vane slot having an opened portion of which direction is not consistent with a moving of the vane, wherein a fixing member is inserted and fixed to the opened portion.

* * * * *